US007473214B2

(12) United States Patent
Schuurmans Stekhoven et al.

(10) Patent No.: US 7,473,214 B2
(45) Date of Patent: Jan. 6, 2009

(54) PELVIC FLOOR TRAINING DEVICE

(75) Inventors: Marco Schuurmans Stekhoven, Zürich (CH); Bernhard Brinkhaus, Limmat (CH); Karel Noten, Harmelen (NL); Hendrik Kwant, Barneveld (NL); Splinter Justus Spierenburgh, Eindhoven (NL)

(73) Assignee: MSYS AG, Zurich (CH)

( * ) Notice: Subject to any disclaimer, the term of this patent is extended or adjusted under 35 U.S.C. 154(b) by 24 days.

(21) Appl. No.: 10/598,178

(22) PCT Filed: Feb. 18, 2005

(86) PCT No.: PCT/EP2005/001730

§ 371 (c)(1),
(2), (4) Date: Aug. 21, 2006

(87) PCT Pub. No.: WO2005/079926

PCT Pub. Date: Sep. 1, 2005

(65) Prior Publication Data

US 2007/0142191 A1 Jun. 21, 2007

(30) Foreign Application Priority Data

Feb. 19, 2004 (NL) ..... 1025526

(51) Int. Cl.
*A63B 26/00* (2006.01)

(52) U.S. Cl. ..... 482/142; 600/587

(58) Field of Classification Search ..... 482/148, 482/142, 1–9; 600/591; 128/905; 601/46
See application file for complete search history.

(56) References Cited

U.S. PATENT DOCUMENTS

| | | | | |
|---|---|---|---|---|
| 5,411,548 | A * | 5/1995 | Carman | 607/138 |
| 5,531,226 | A * | 7/1996 | Harris | 600/587 |
| 6,436,029 | B1 * | 8/2002 | Benderev | 600/30 |

FOREIGN PATENT DOCUMENTS

| | | |
|---|---|---|
| KR | 416937 | 1/2004 |
| KR | 416937 B1 | 1/2004 |
| WO | 2004/045411 A1 | 6/2004 |

* cited by examiner

*Primary Examiner*—Lori Amerson
(74) *Attorney, Agent, or Firm*—Dennison, Schultz & MacDonald

(57) ABSTRACT

A training device for training the pelvic floor muscles of a human, which can be externally placed on the human body and can be connected to feedback units that produce feedback signals, such as vibrations. The training device is, at least on one side, aligned with the pelvic floor, can be compressed and can be axially deformed on its sensor side. A pressure force sensor unit of the training device can be positioned during the operation in such a manner that the ischial tuberosities of the pelvic floor can be situated on both sides on the pressure sensor unit, and a gravitational force component passing through the pelvic floor acts upon the pelvic floor training device, making a precise measurement of the exertion on the pelvic floor possible.

13 Claims, 3 Drawing Sheets

PELVIC FLOOR TRAINING DEVICE

Figure 1:
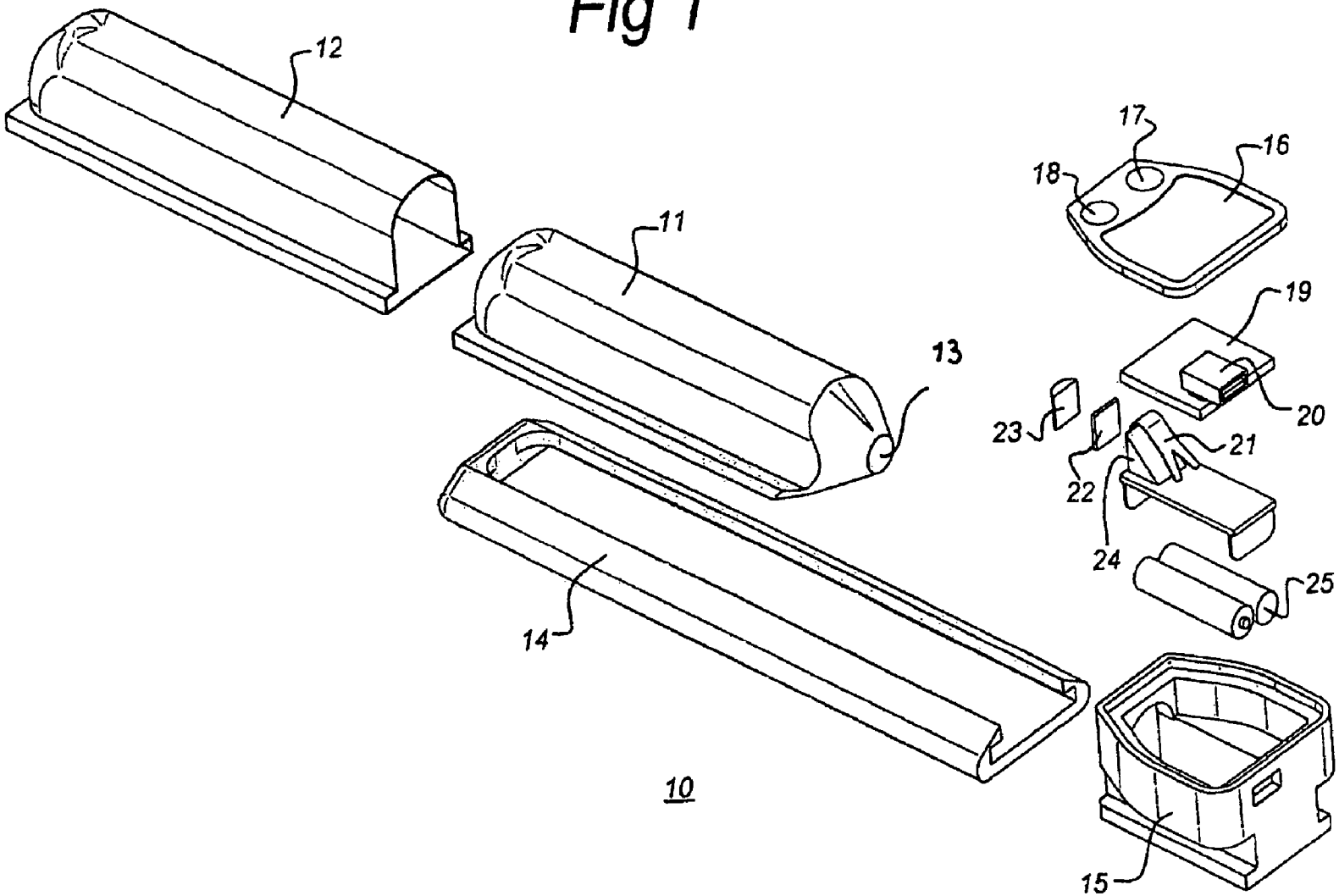

This application is a filing under 35 USC 371 of PCT/EP2005/001730 filed Feb. 18, 2005.

FIELD OF THE INVENTION

The present invention relates to a device which is used for training the muscles in the pelvic floor of a human being. The device contains pressure or force transducers which are placed externally on the human body. The extremely soft muscles are coupled to a suitable pressure force sensor unit with feedback facilities whilst the person is seated and thus by virtue of gravitational force.

PRIOR ART

A training device for the same problems is known for example from U.S. Pat. No. 5,531,226 A. The known training device comprises a tubular body which elastically expands after compression. The document does not define precisely where this tubular body can be compressed. Moreover, a great disadvantage of training devices of this type is that they must be worn directly against the skin in order to be effective. This means that such a device can only be used by one individual or must be thoroughly cleaned before or after use.

U.S. Pat. No. 6,436,029 B1 describes a training device for training the pelvic floor muscles, which device comprises a saddle-type element having built-in control and stimulation means, which element is placed against the body and can exert selective pressure at various sites.

Furthermore, there are training devices (e.g. WO 2004/045411 A), where the body is to be coupled by a mechanical height adjuster to a chair device. Furthermore, intra-corporal coupling mechanisms of electrical measuring and stimulating electrodes are proposed, which may be used practically only in urological practices.

SUMMARY OF THE INVENTION

The object of the invention is to provide a training device for the pelvic floor muscles, which device renders it possible to measure the pressure or force in a defined and convenient manner on the pelvic floor muscles.

The subject of the invention is thus a training device for training human pelvic floor muscles, which for training purposes is provided for placing externally on the human body directly or indirectly between the two ischial bones whilst the human is seated. The training device comprises a pressure force sensor unit which can be compressed at least on the side facing the pelvic floor and which can expand on a side which is not facing the pelvic floor, a force transducer which is coupled to the pressure force sensor unit on its side which can expand, and a feedback unit which is connected to the force transducer and generates a feedback signal, for example vibrations of the filling.

During a measuring and training period it is possible according to the present invention for the state of the muscle activity which has just been measured to be stimulated by way of the coupling measuring unit itself.

The present invention provides a training device having a pressure force sensor unit such that the force emitted by the pelvic floor muscles can always be coupled vertically. This is possible because the pressure force sensor unit can be compressed on all sides and the pressure force sensor unit is located during the operation between the ischial bones of the pelvic floor. In the absence of any muscle activity only the gravitational force which can be compensated electronically has an effect. The training device according to the invention comprises few components and it can be manufactured in a convenient manner.

The training device according to the said invention can be used without it having to be worn on the body. This is more hygienic than known training devices and it measures more accurately owing to the pressure force sensor system and the seated position of the user. During tensing of the pelvic floor a muscle pressure force occurs which can be measured precisely.

In the case of an advantageous embodiment of the training device according to the invention the pressure force transducer comprises a radially elastic body which is filled with a fluid, gel or gas and a sensor which is suitable for measuring the force of pressure.

The pressure force measuring units and or the feedback units can be adjusted during operation to a zero position. As a consequence the weight-induced signal is separated and only then can the tensing of the pelvic floor muscles be measured.

The measured pressure force of the pelvic floor muscles is evaluated as amplitude in dependence upon the time in an allocated evaluating or monitoring unit. As a consequence, it is possible to represent the different phases of training (inactivity, tensing and relaxation) for the user, whereby the effectiveness of training is increased. This information can be represented, for example, by the amplitude and frequency (tensing and relaxation) of the wave forms. External devices can be connected for evaluation purposes, for example a printer, personal computer and the like.

The training device according to the invention can comprise a receiving seat element in which the pressure force sensor unit can be positioned. The training device is as a consequence easy to use and can be integrated on the seating surface of a chair or as the a seat of a fitness device or the like. A device for adjusting the height of the pressure force sensor unit in relation to the seat part can be provided. By virtue of an arrangement of the pressure force sensor unit which is comfortable for the user it is possible to achieve an improved contact with the force transducer which improves the signal quality.

SHORT DESCRIPTION OF THE DRAWINGS

Figure 2:
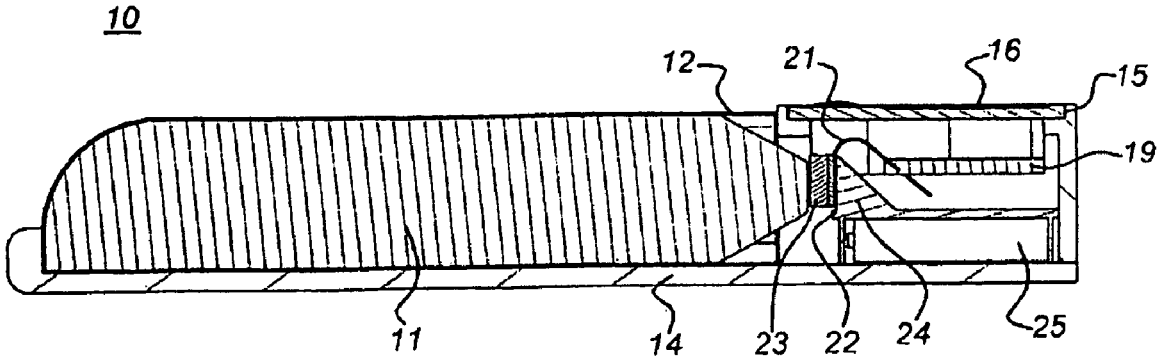
Figure 3:
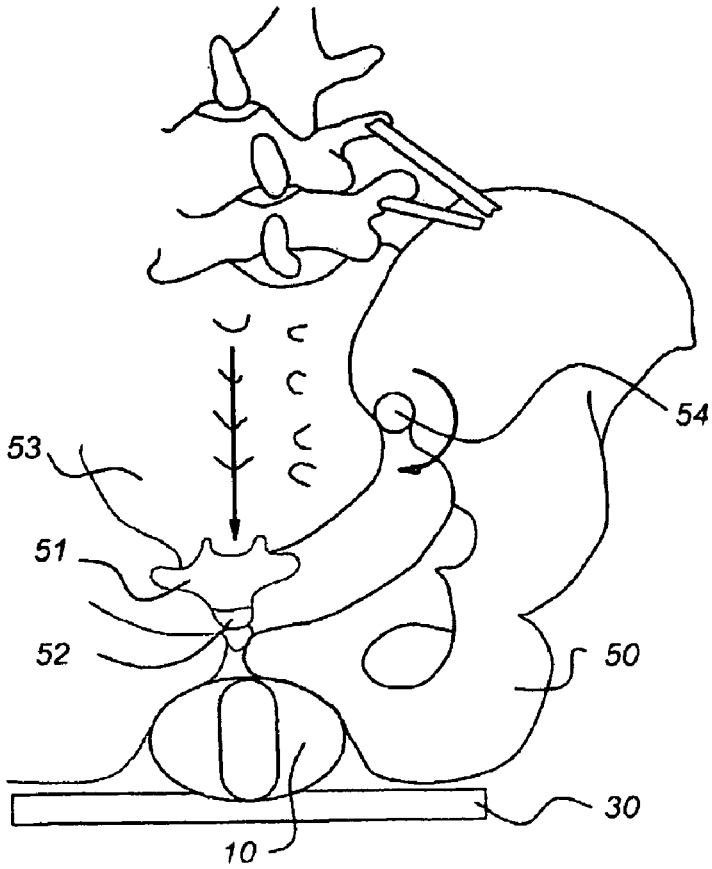
Figure 4:
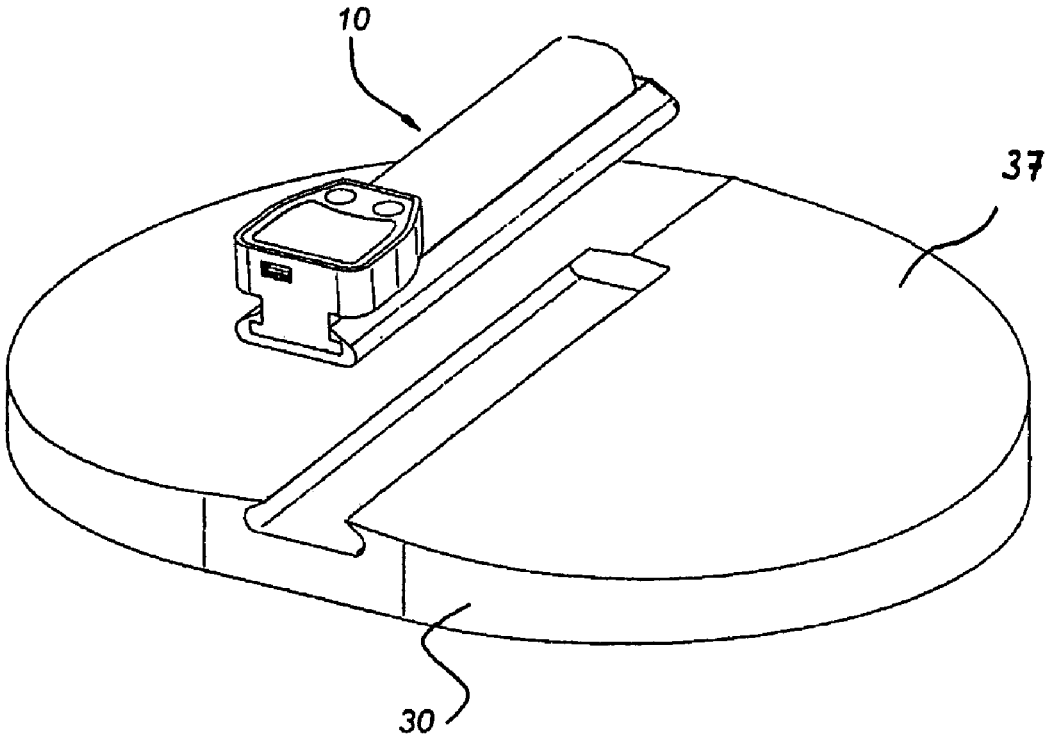
Figure 5:
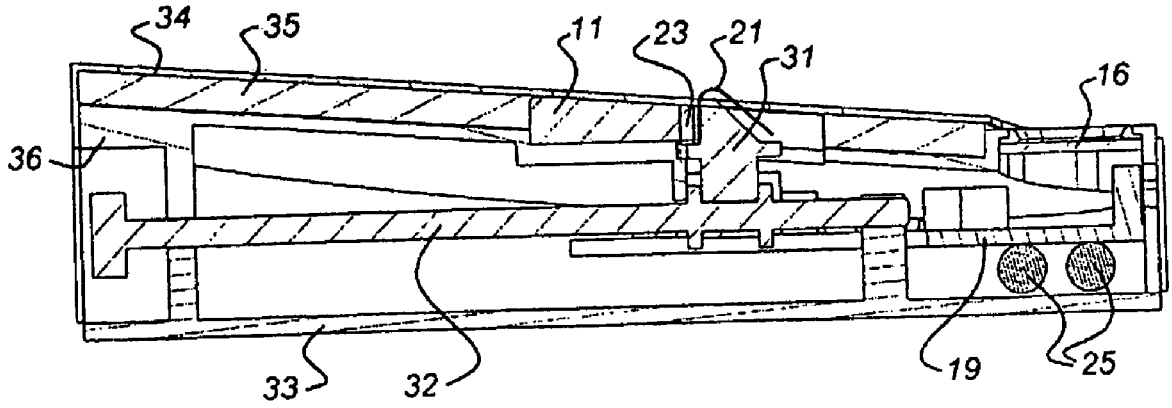

The present invention is described in more detail below with reference to exemplified embodiments and with reference to the drawing, in which:

FIG. 1 is an exploded view which illustrates a first embodiment of the training device according to the invention, FIG. 2 is a cross-sectional view of the training device shown in FIG. 1, FIG. 3 is a schematic illustration of a training device during use, FIG. 4 is a perspective view of a second embodiment of the training device according to the invention with a seat part and FIG. 5 is a cross-sectional view of a further embodiment of the training device according to the invention with a seat part.

DETAILED DESCRIPTION OF EXEMPLIFIED EMBODIMENTS

FIG. 1 shows an exploded view and FIG. 2 shows a cross-sectional view of a first embodiment of the training device 10 for the pelvic floor muscles according to the invention.

The training device 10 comprises an easily deformable part (fill media: fluids, gels or gases in a spherical body or the like) as a pressure force sensor unit 11, which is held in a shell-like body 12 which can expand in the radial direction but not in the axial direction. The shell-like body 12 ensures that the pressure force sensor unit 11 can deform, i.e. can be compressed, by means of the force of pressure only in the radial direction. The shell-like body can only expand in the axial direction on the sensor-side end face 13.

The combination of the pressure force sensor unit 11 and the shell-like body 12 can be held in a base plate 14. The pressure force sensor unit 11 is for example manufactured from an elastic spherical body which is filled with fluid, gel or gas.

In addition, a housing 15 can be inserted into the base plate 14. The housing 15 provides space for a display unit 16, for example an LCD-display, various actuating keys (on/off key 17, zero key 18) and a plurality of other switching elements which are disposed for example on a circuit board (PCB) 19 with components which can be provided for example with a USB connector 20. Furthermore, the housing 15 provides space for a retaining body 24, in which for example batteries 25 can be placed. Moreover, the retaining body 24 holds a pressure force sensor 21, a pressure force distributor or actuator 22 for initiating muscle-stimulating functions and a pressure conductor 23. These ensure that any pressure force introduced to the pressure force sensor 21 is further transmitted exactly.

The housing 15 can be positioned at various sites with reference to the pressure force sensor unit 11 and the shell-like body 12. This can be achieved in many ways known to the person skilled in the art, for example using a self-locking slot in the base plate 14.

FIG. 3 shows a schematic illustration of a training device during use. It illustrates how the pelvic floor training device 10 according to the invention can be used in practice.

The pelvic floor in a human being consists of a number of boney structures which are held together by muscles. The most important boney structures in the pelvic floor are the two ischial bones 50 (tuber Ischiadicum), the pubic bone 51 (os pubis), the coccyx 52 (os coccygis) and the sacral bone 53 (os sacrum).

The pelvic floor training device 10 according to the invention is used by a person in the seated position. The two ischial bones 50 are located in parallel on the side of the device 10. When a person sits on the device 10, the pelvic floor (perineum) expands and in fact on the one hand owing to the pressure force sensor unit 11 and on the other hand, because the ischial bones move apart from each other as a consequence of the effect of the gravitational force on the rotation axis 54 of the pelvic joint. Owing to the fact that a person tenses his/her pelvic floor muscles during training, the ischial bones 50 move back towards each other, whereby the pressure senor unit 11 is radially compressed. The pressure force sensor unit 11 can not expand on the lower side because the base plate is rigid and on the top side the pelvic floor muscles are attempting to assume their normal position. As a consequence the pressure force sensor unit 11 is simultaneously compressed radially from the top and from the side.

The pressure force sensor unit 11 can exert the pressure force generated therein only on the side of the pressure force sensor 21. All the forces exerted during the training are transmitted in this manner by the pressure force sensor unit 11 and transmitted to the pressure force sensor 21. The signal from the pressure force sensor 21 is (electronically or mechanically) processed into a feedback signal which is displayed to the user as the pelvic floor muscles are tensed. The feedback signal is set such that the device displays zero force on its display device 16 when the pelvic floor muscles are not tensed. Thus, the large gravitational force is separated from the small measuring signal. Each change in the amount of tensing force in the pelvic floor muscles is thus visible in the feedback signal.

During pelvic floor training, different muscles and muscle groups are trained, both the deep muscle layers (diaphragma pelvica) and also the surface muscles (diaphragma urogenitalis). This is useful for different types of treatment of problems such as incontinence, sexual disfunctions, back pain and erection malfunctions.

With the training device according to the invention, the different phases of training (relaxing and tensing) are made clear and visible and in fact both quantitatively and also qualitatively.

The feedback can take place with the aid of a display device 16, for example in the form of an audio signal or optically by means of a pointer or an analogue or digital display 16.

The electronic unit 19 is provided with components, such as for example a processor and associated memory elements which are designed to amplify and store the signal of the pressure force sensor 21 and to generate a feedback signal which is transmitted to the display unit 16. The electronic unit 19 is supplied by a battery, internal solar cells or an external current source.

FIG. 4 illustrates a further embodiment of the training device 10 according to the invention. The device is provided in addition with a seat part 30 which is provided with a slot at the site where the training device 10 can be inserted. In an expedient manner the upperside of the seat part has two surface areas 37 which are provided with surfaces which slope to the side and forwards. As a consequence, an optimum seating position is produced (upright and tensed against the gravitational force) to perform the training of the pelvic floor muscles.

FIG. 5 illustrates a cross-sectional drawing of a further embodiment of the invention. In the case of this embodiment the pelvic floor training device is integrated in the seat part. It consists of a lower or base part 33, a retainer 36 on which is mounted the pressure force sensor unit 11 and an upper part 35 which is possibly covered with material 34.

The electronic unit 19 can be attached to the lower part 33 with the batteries 25 thereunder. The display unit 16 possibly with operating keys is disposed thereabove. The pressure force sensor unit 11 is attached to the retainer 36, but it can transmit the force to the pressure force sensor 21. The pressure force sensor 21 is attached to an adjustable sensor holder 31 and by means of a pressure force conductor 23 and pressure force distributor (or actuator for initiating muscle-stimulating functions) 22 absorbs the force exerted by the pressure force sensor unit 11.

The adjustable sensor holder 31 is attached to the lower part 33. If an adjusting device 32 is rotated it leads to a reciprocal movement of the sensor holder 31. In this manner the device 10 can be adjusted whilst idle such that the pressure force sensor unit 11 just touches the pressure force conductor 23. This adjustment can be performed individually for each user of different weights.

All the forces exerted during the training of the pelvic floor muscles are now transmitted by the pressure force sensor unit 11 to the pressure force sensor 21. The adjusting device 32 is suspended in the base part 33 in an expedient manner such that the sensor holder 31 can only be adjusted over a limited range.

The invention claimed is:

1. Training device for training human pelvic floor muscles, constructed and arranged for placement externally against the human body directly or indirectly between two ischial bones in a seated position, comprising:

a pressure sensor unit, which is compressible at least on a side facing the pelvic floor and expandable on a side not facing the pelvic floor, and which comprises a flexible body which contains gas, gel or fluid material and is held on a surface facing the pelvic floor by a non-expandable shell-like body, a force transducer coupled to the pressure sensor unit on the expandable side thereof, and a feedback unit, which is connected to the force transducer, to generate a feedback signal.

2. Pelvic floor training device as claimed in claim 1, wherein the feedback signal is a vibration signal.

3. Pelvic floor training device as claimed in claim 1, wherein the pressure sensor unit comprises a flexible body with compressible material therein.

4. Pelvic floor training device as claimed in claim 3, wherein the flexible body contains gas, gel or fluid material which is held on the surface facing the pelvic floor by a non-expandable shell-like body.

5. Pelvic floor training device as claimed in claim 1, wherein the flexible body has a substantially cylindrical shape and the expandable side is located on a cylinder end face.

6. Pelvic floor training device as claimed in claim 3, wherein the pressure sensor unit and the force transducer are adjustable in relation to each other.

7. Pelvic floor training device as claimed in claim 1, additionally comprising a seat part in which the pelvic floor training device is positioned.

8. Pelvic floor training device as claimed in claim 7, additionally comprising a device for adjusting the pressure sensor unit in height with respect to the seat.

9. Pelvic floor training device as claimed in claim 1, wherein the transducer records a zero sensor signal for an idle state.

10. Pelvic floor training device as claimed in claim 1, additionally comprising means for displaying a time-dependent illustration of the feedback signal.

11. Pelvic floor training device as claimed in claim 1, additionally comprising signal processing devices for processing and registering the measuring or feedback signals connected or coupled to the force sensor.

12. Pelvic floor training device as claimed in claim 1, additionally comprising a pressure force distributor or actuator with the force transducer to introduce muscle-stimulating functions.

13. Pelvic floor training device as claimed in claim 1, wherein the shell like body comprises a rigid base plate constructed and arranged to be positioned opposite to the pelvic floor, and one end portion which is open and at which the pressure sensor unit is coupled to the force transducer.

* * * * *